United States Patent [19]

Habas et al.

[11] 4,167,131

[45] Sep. 11, 1979

[54] SKIP PERFORATOR

[75] Inventors: Walter F. Habas; Laurence E. Elliott, both of Savannah, Ga.

[73] Assignee: Union Camp Corporation, Wayne, N.J.

[21] Appl. No.: 906,953

[22] Filed: May 18, 1978

[51] Int. Cl.[2] ..... B23D 25/12

[52] U.S. Cl. ..... 83/304; 83/315; 83/344; 83/348; 83/528

[58] Field of Search ..... 83/315, 316, 343, 344, 83/347, 348, 304, 305, 528

[56] References Cited

U.S. PATENT DOCUMENTS

| | | | |
|---|---|---|---|
| 2,345,072 | 3/1944 | Rosenlea et al. | 83/344 |
| 2,762,433 | 9/1956 | Russell | 83/344 |
| 3,566,735 | 3/1971 | Greene | 83/344 |
| 4,058,041 | 11/1977 | Ito | 83/528 |

*Primary Examiner*—Robert L. Spruill
*Assistant Examiner*—W. D. Bray
*Attorney, Agent, or Firm*—Kane, Dalsimer, Kane, Sullivan and Kurucz

[57] ABSTRACT

Apparatus for producing all over pin hole perforations in the plies for multiwall bags except at the tops and bottoms in the area of interply pasting.

4 Claims, 4 Drawing Figures

SKIP PERFORATOR

BACKGROUND OF THE INVENTION

1. Field of the Invention

The invention relates to all over pin hole perforations in the plies for multiwall bags and more particularly to apparatus for producing all over pin hole perforations in a skip pattern. A skip pattern is desirable for preventing interply paste from leaking through the perforations.

2. Brief Description of the Prior Art

Multiwall bags with all over pin hole perforations have been manufactured and used for many years. The purpose of the perforations is to allow air to escape while the bags are being filled (with the end product). The original method of perforating was to position a unit between the paper unwind stands and the mutiwall tubing machine, hereafter called the tuber; this unit consisted of a roll with protruding pins equidistant around the circumference, as well as laterally across the face of the roll—and geared to an adjacent roll having grooves cut circumferentially, corresponding in lateral position with the pins. The pile sheet would be pulled between these rolls, and friction would cause them to rotate, perforating the paper in an all-over pattern. The pile sheet was then separated in the tuber into individual plies for interply pasting, and recombined to form a tube. This resulted in a misalignment of the holes—from ply to ply—in the finished bag, which allowed air to escape while filling, but minimized product sifting.

In some later bag designs, all but the outside ply were perforated, allowing air to escape through the porous outside sheet but with no product sifting. In other designs the various plies would have different hole patterns and sizes. Some specifications called for perforating the sheets from inside out and others from outside in. The introduction of barrier films made the perforating process more difficult because of a tendency of punctures in film to reclose. Replacing the grooved roll with a brush roll sometimes facilitated the perforation of films. In most instances the new bag designs required the use of more than one perforating unit—sometimes a unit for each ply.

In all of these prior designs, from oldest to most recent, the perforations formed a continuous pattern—hence the name "all over pin hole perforations". This configuration has presented certain problems to the bag maker. All pasted multiwall tubes have interply pasting, consisting of rows of paste dots applied between plies at the tops and bottoms of the tubes, to hold them together. The paste application is timed to the same position on every bag. Frequently, it happens that paste is applied over pin hole perforations, resulting in paste leaking through the holes. Leaks to the inside of the finished tubes may stick them shut, such that they cannot be readily opened in the bottoming operation. Leaks to the outside of the tubes may result in their being stuck together in a finished stack.

The apparatus of the present invention overcomes the disadvantages of the prior designs by providing for skip perforation wherein the tubes for multiwall bags are all-over perforated except at the tops and bottoms of the tubes in the area where the plies are pasted together.

SUMMARY OF THE INVENTION

The invention comprises apparatus for all-over and skip perforation of a ply for a multiwall bag moving between the ply unwind stand and the multiwall tuber comprising:

- one or more spaced idler rolls and a back-up roll interposed between the idler rolls;
- the idler and back-up rolls being driven by friction from the moving ply;
- a perforator pin roll positioned parallel to the first idler and back-up rolls and adjacent to the back-up roll, the ends of the perforator pin roll being connected to the ends of the first idler roll to permit the perforator pin roll to pivot about the first idler roll;
- the perforator pin roll being driven from the first idler roll at the speed of the first idler roll; and
- means to move the perforator pin roll into and out of contact with the moving ply against the back-up roll;
- whereby the all-over perforation of the ply can be interrupted for predetermined periods to provide no perforation in areas of the ply where interply pasting will occur.

DETAILED DESCRIPTION OF THE PREFERRED EMBODIMENTS OF THE INVENTION

Figure 1:
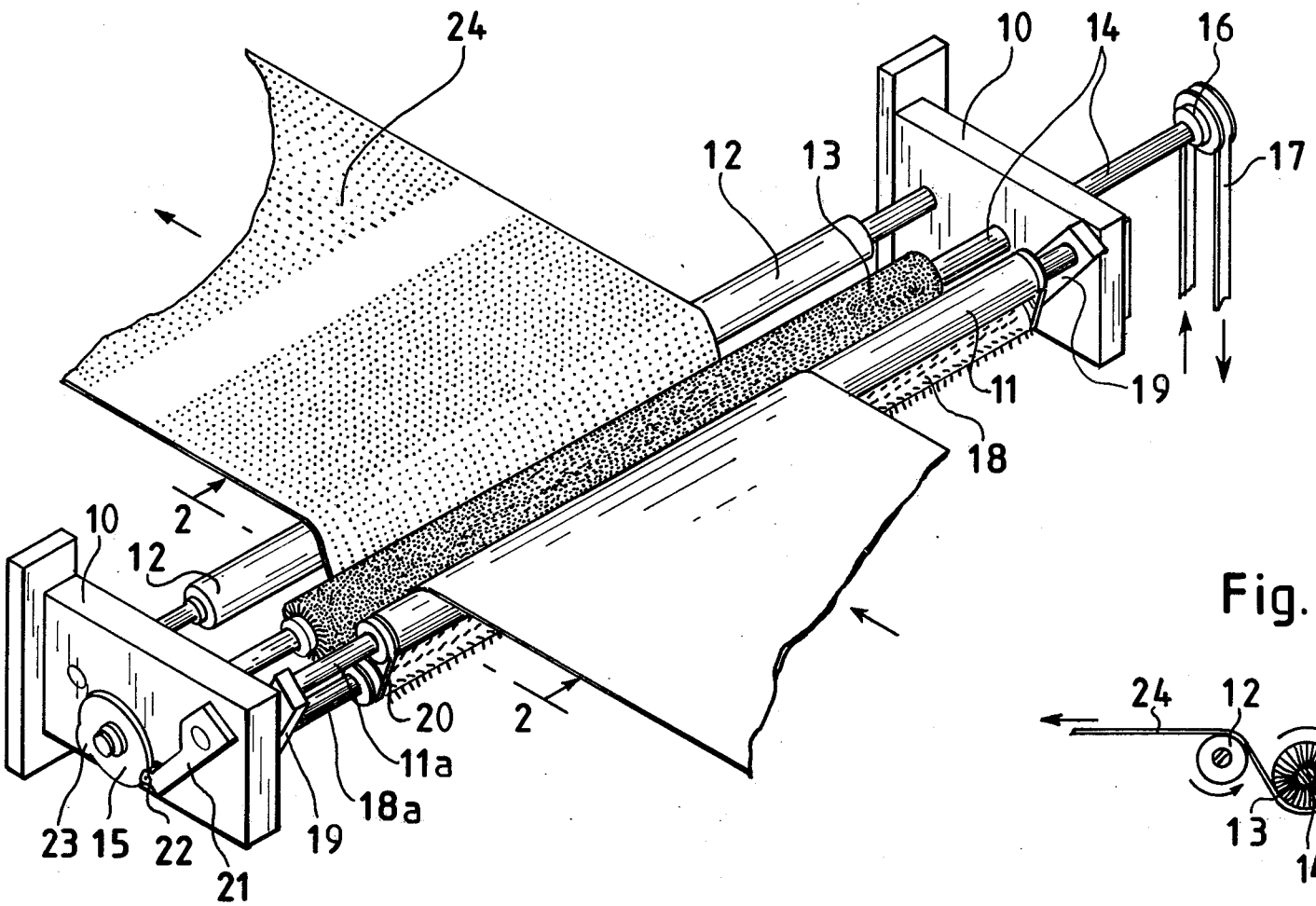
FIG. 1 is an isometric view of the apparatus of the present invention with the perforator pin roll in contact with the back-up roll for all over perforation of the ply.

Referring to the drawings there is shown in FIG. 1, the apparatus of the present invention interposed between the ply unwind stand and the multiwall tubing machine (tuber). Such apparatus comprises a pair of spaced frame members 10 on which are mounted first and second idler rolls 11 and 12, respectively, and a back-up roll 13. The idler rolls 11 and 12 are free wheeling so that they will run by friction at the speed of the ply passing over such rolls. The back-up roll 13 is bearing mounted on a shaft 14 which passes through the frame members 10 and is likewise free-wheeling. Such shaft 14 has a cam 15 mounted on one end and a pulley 16 mounted at the other end which pulley is driven by a belt 17 which is interconnected to the drive of the tuber so that the cam 15 can be driven in synchronization with the tuber.

A perforator pin roll 18 has a shaft **18*a* with its ends rotatably mounted in the ends of a pair of blocks 19. The opposite ends of the blocks 19 are affixed to the shaft 11*a* of the first idler roll 11. The shafts 11*a* and 18*a* are spaced from and parallel to each other. Since the blocks 19 are affixed to the first idler roll shaft 11*a* it will be apparent that the shaft 18*a* and perforator pin roll 18 will pivot about the first idler roll 11. The perforator pin roll 18 and first idler roll 11 are driven at the same speed by belts 20. Since the first idler roll 11 is run by friction at the speed of the ply running over the roll, the perforator pin roll will likewise run at the speed of the moving ply. The perforator pin roll 18 is parallel to and adjacent to the back-up roll 13 so that as the perforator pin roll pivots about the first idler roll 11 it can be brought into and out of contact with the ply and back-up roll 13**.

Also affixed to the shaft 11*a* of the first idler roll 11 is a cam lever 21 with a cam follower (or roller) 22 positioned to make contact with the outer edge of the cam 15. Such outer edge of the cam 15 defines a circle about the shaft 14 with the exception of a projection 23. Such cam lever is spring loaded to keep the lever in constant contact with the cam.

It will be understood that an enclosed or face cam can be used in place of the cam heretofore described. In such case the follower rides in a groove milled into the cam plate, instead of on the periphery as with a conventional plate cam. The use of a face cam would eliminate the need for a spring and would prevent bouncing. Electrical means can also be used to bring the perforator pin roll into and out of contact with the ply and back-up roll.

The ply 24 to be perforated comes from the unwind stand and passes over the first idler roll 11, under the back-up roll 13 and then over the second idler roll 12 after which it continues to the tuber. Where the term "ply" is used herein it means paper and also barrier films which can be plastic, foil or other materials which serve as barriers in a multiwall bag.

Since the perforator pin roll has protruding pins equidistant around the circumference of the roll as well as laterally across the roll, it has been the practice to use a back-up roll having grooves corresponding to the positions of the pins. However, with the introduction of barrier films, the perforating operation has become more difficult because of the tendency of the punctures in film to reclose. By replacing the grooved back-up roll with a brush roll it has facilitated the perforation of films. A back-up roll having a facing of soft material, such as rubber, foam, elastomer, or the like, will likewise operate satisfactorily so long as the pins can penetrate through the ply and into (or beyond the surface of) the roll.

Figure 2:
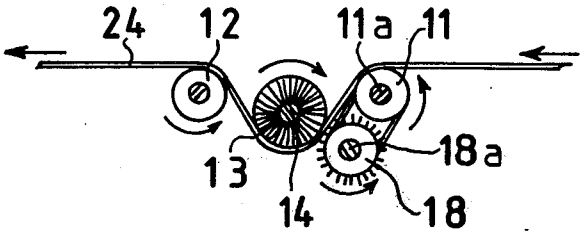
FIG. 2 is a sectional view along the line 2—2 of FIG. 1.
Figure 3:
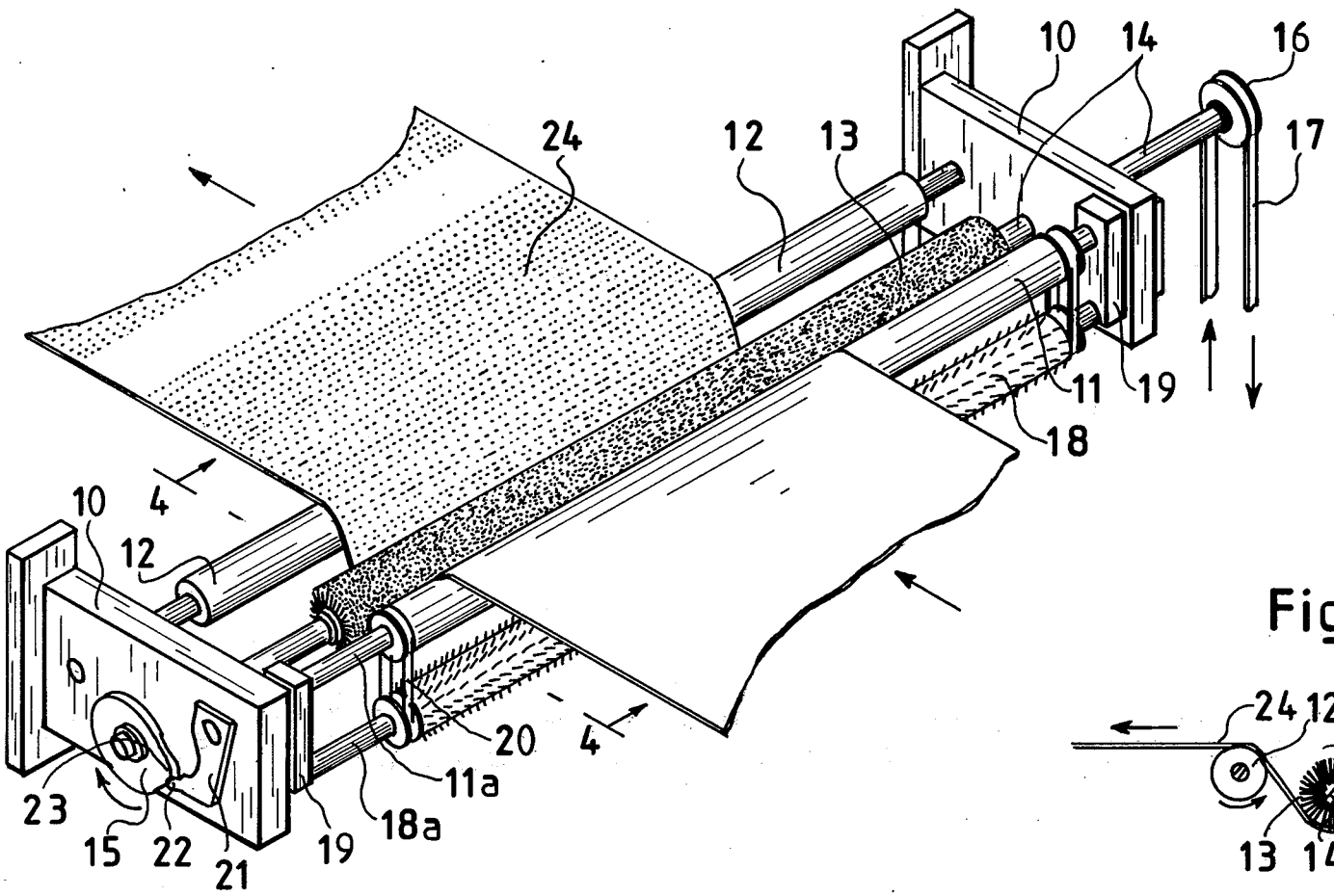
FIG. 3 is a view of one end of the apparatus of FIG. 1 showing the position of the cam and cam lever when the perforator pin roll is out of contact with the back-up roll for skip perforation.

In operation the ply passes over the idler rolls 11 and 12 and under the back-up roll 13, the moving ply running at the speed of the tuber. The friction of the ply on the idler and back-up rolls runs those rolls at the speed of the moving ply. The cam is also in synchronization with the speed of the tuber. Initially the cam follower 22 of the cam lever 21 is running on the circle portion of the edge of the cam 15 so that the blocks 19 rotate the perforator pin roll about the first idler roll and maintain such pin roll in contact with the ply running against the back-up roll (FIGS. 1–2). The pin roll will thus perforate the ply in an all over pattern (see "perforated area" of FIG. 3).

Figure 4:
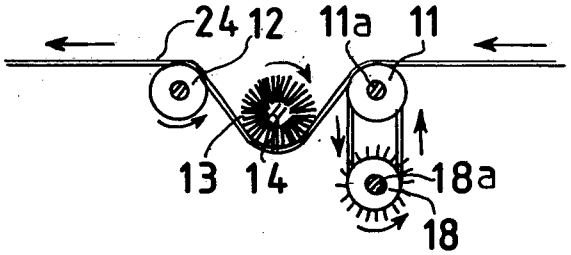
FIG. 4 is a sectional view along the line 4—4 of FIG. 3.

When the rotating cam 15 brings the projection 23 into contact with the cam follower 22, the cam lever 21 will move outwardly. This causes the blocks 19 to move the perforator pin roll out of contact with the ply (FIGS. 3–4) so that for a short interval the ply will not be perforated (see"interply pasting" area of FIG. 3).

It will be noted that the perforator pin roll will run at the same peripheral speed as the first idler roll and the moving ply even when such pin roll is out of contact with the moving ply. This prevents the pins of the pin roll from tearing the ply when the pins move back into contact with the ply.

The cam action is adjustable but is set so that preferably about six inches of the tube length plus or minus, will remain unperforated during the skip portion of the cycle. After the perforated plies have been combined into a tube the tubing is severed at the center of the unperforated area so that the finished tubes will be free of holes at the tops and bottoms of the tubes in the area of interply pasting.

While the device could be used for perforation of all plies simultaneously, it has been found that it is more desirable and efficient from a practical standpoint for each ply to be separately skip perforated. In some cases this will mean one skip perforating unit for the inner ply and one for the outer ply and possibly another unit for the intermediate plies. In other cases it may mean a separate unit for every ply.

Those skilled in the art will appreciate that many variations of the above described embodiment of the invention may be made without departing from the spirit and the scope of the invention.

What is claimed is:

1. Apparatus for all-over and skip perforation of a ply for a multiwall bag moving between the ply unwind stand and the multiwall tuber comprising:

an idler roll and a back-up roll spaced from each other to permit the moving ply to pass from the idler roll to the back-up roll;

the idler and back-up rolls being driven by friction from the moving ply;

a perforator pin roll positioned parallel to the idler and back-up rolls and adjacent to the back-up roll, the ends of the perforator pin roll being connected to the ends of the idler roll to permit the perforator pin roll to pivot about the idler roll;

the perforator pin roll being driven from the idler roll at the speed of the idler roll; and means to move the perforator pin roll into and out of contact with the moving ply against the back-up roll;

whereby the all-over perforation of the ply can be interrupted for predetermined periods to provide no perforation in areas of the ply where interply pasting will occur.

2. The apparatus of claim 1 wherein the surface of the back-up roll is adapted to receive the pins of the perforator pin roll which penetrate through the ply moving against the back-up roll.

3. The apparatus of claim 2 wherein the back-up roll is a brush roll.

4. The apparatus of claim 1 wherein the means to move the perforator pin roll into and out of contact with the moving ply comprises:

a cam secured to the shaft of the back-up roll, a portion of the cam defining a circle and a raised projection about the shaft;

the said cam being driven in synchronization with the tuber;

a cam lever provided with a cam follower positioned and adapted to make contact with the said portion of the cam;

the said cam lever being affixed to the shaft of the idler roll;

whereby the cam lever will rotate and pivot the perforator pin roll about the idler roll to bring the pin roll into and out of contact with the moving ply.

* * * * *